US006929072B2

(12) United States Patent
Brown

(10) Patent No.: US 6,929,072 B2
(45) Date of Patent: Aug. 16, 2005

(54) ROOF SOAKING DEVICE AND METHOD

(76) Inventor: Wes Brown, 2979 Indian Wells Dr., Prescott Valley, AZ (US) 86314

( * ) Notice: Subject to any disclaimer, the term of this patent is extended or adjusted under 35 U.S.C. 154(b) by 0 days.

(21) Appl. No.: 10/716,751

(22) Filed: Nov. 19, 2003

(65) Prior Publication Data

US 2005/0103507 A1 May 19, 2005

(51) Int. Cl.[7] ..... A62C 2/00; A62C 25/00; A62C 31/22; B05B 3/00

(52) U.S. Cl. ..... 169/46; 239/736; 239/745; 239/208; 239/276; 169/52; 169/54; 169/68; 169/70

(58) Field of Search ..... 239/736, 745, 239/746, 208, 209, 198, 390, 276; 169/45, 169/46, 52, 54, 66, 68, 70, 16

(56) References Cited

U.S. PATENT DOCUMENTS 693,421 A * 2/1902 Munch ..... 239/745
3,653,444 A 4/1972 Livingston
3,754,600 A 8/1973 Miller
4,201,343 A * 5/1980 Stenild ..... 239/745
4,713,033 A 12/1987 Cameron
4,836,291 A 6/1989 Owens et al.
5,249,632 A 10/1993 Sparling et al.
5,425,181 A 6/1995 Calvert
6,360,968 B1 3/2002 Orrange et al.
6,508,683 B1 1/2003 Garcia

FOREIGN PATENT DOCUMENTS

JP 2000127912 5/2000

* cited by examiner

*Primary Examiner*—David A. Scherbel
*Assistant Examiner*—Seth Barney

(57) ABSTRACT

A device and method for inhibiting the spread of a fire to the roof of a building by placing a base supporting a sprinkler on the roof. A hose connected to the base and in fluid communication with the sprinkler provides a source of water ejected from the sprinkler onto the roof. The interior of the base may be wetted to increase its weight. A rope, normally stored on a spool removably attached to the base, may be used to reposition the base on the roof.

17 Claims, 1 Drawing Sheet

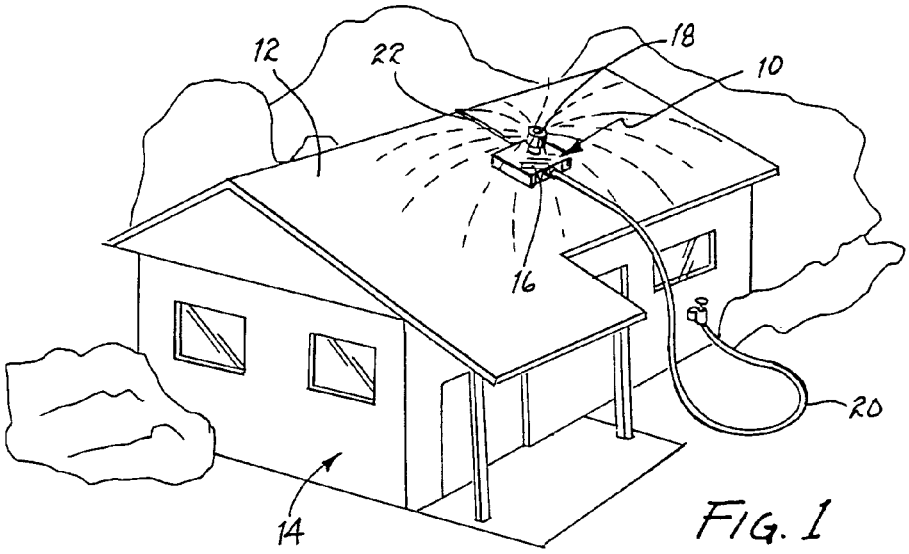
FIG. 1
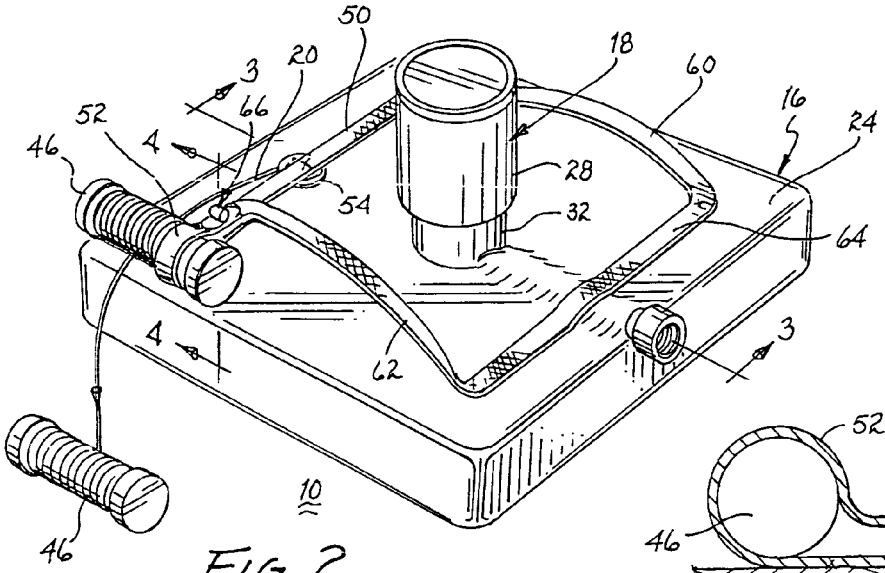
FIG. 2
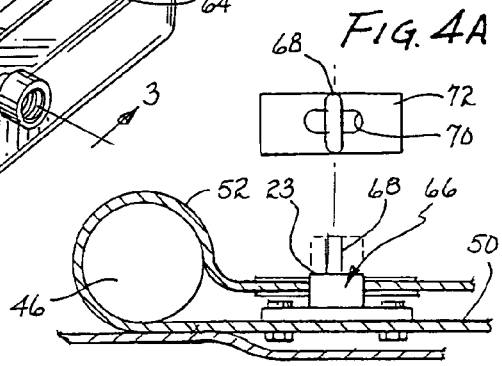
FIG. 4A
FIG. 4
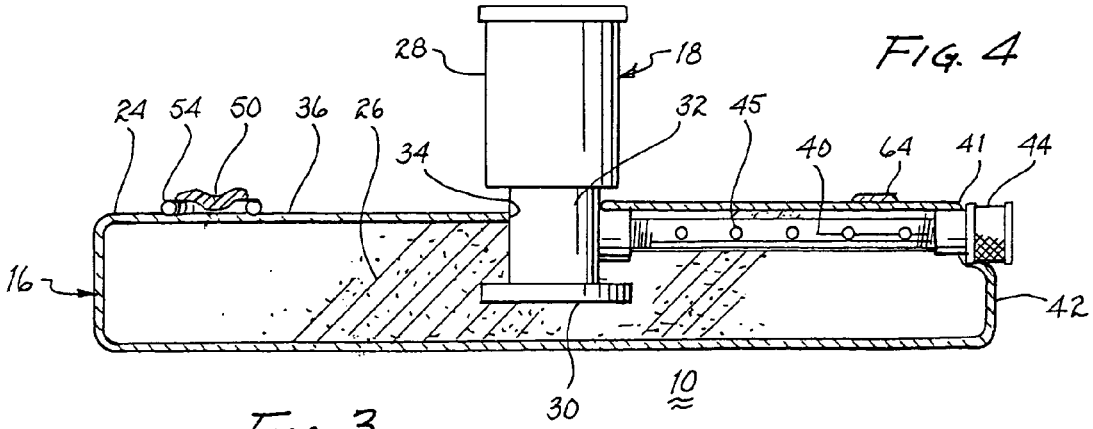
FIG. 3

ROOF SOAKING DEVICE AND METHOD

BACKGROUND OF THE INVENTION

1. Field of the Invention

This invention relates to protection devices and methods used with buildings and, more particularly, to devices and methods for discouraging the spread of a wild fire to the roof of a building.

2. Description of the Related Art

The spread of wild fires to residential areas is a constant threat in many locations, particularly during dry seasons. Often such wild fires cause damage to many homes and buildings which are burned either from direct contact with flames or from embers spewed from the fire that fall on the roofs of homes and buildings and, sometimes from a long distance from the fire. Thus, such fires threaten destruction to large areas crowded with residential homes and other buildings.

A variety of water systems for controlling fires which frequently occur on a dwelling or a building have been employed in the past. Such systems are disclosed in U.S. Pat. Nos. 5,263,543, 3,653,444, 3,754,600, and 6,360,968; all of which disclose elaborate sprinkler systems which may be installed on a roof top. Roof top systems are often a good tool for fighting a fire which has already started consuming the building, and may also be effective in preventing the fire from spreading to the building in the first place. They may also stop the fire from spreading to neighboring buildings.

Roof top systems are bulky and take time to install on a roof. When the spread of a wild fire is imminent, there may not be enough time to order, deliver, and install a sprinkler system on the roof tops of buildings and single homes not already so equipped.

When a wild fire threatens a certain area, firefighters have little option but to directly fight the fire itself, or take the necessary actions to address the threat of the fire spreading. A lack of manpower and adequate resources in many instances results in devastation of homes and buildings without any type of fire prevention or fire suppression equipment.

Therefore, there is a long standing need to provide a fire prevention system that is inexpensive and can be quickly and easily delivered and installed in most buildings.

It is a primary object of the present invention to provide a fire fighting device which can be quickly and easily implemented by mounting the device on the roof of a building.

Another object of the present invention to provide a device which uses a regular garden hose to spray water on the roof of a building.

Yet another object of the present to provide a lightweight and inexpensive device for preventing fire from spreading to a building.

Still another object of the present invention is to provide an easily storable and transportable device for dousing a roof top with water to prevent ignition from burning embers generated by a near or distant ground fire.

A further object of the present invention is to provide a device easily positionable at a selected location on a roof to discharge a spray of water onto the roof.

A yet further object of the present invention is to provide an inexpensive method for soaking a roof with water to prevent ignition from flames and burning embers of an adjacent fire.

A still further object of the present invention is to provide a method for quickly mounting a device on a roof for discharging a spray of water onto the roof.

These and other objects of the present invention will become more apparent to those skilled in the art as the description of the present invention proceeds.

SUMMARY OF THE INVENTION

The present invention relates to a device and to a method for fighting and/or preventing a fire in close proximity from spreading to and damaging a building. The device is lightweight, inexpensive, and can easily be mounted on the roof of the building in a few minutes. The device is hooked up to a regular garden hose to discharge a spray of water and soak the roof with water. Thus, the fire will be less likely to spread to the soaked roof of the building, and may also prevent the fire from spreading to neighboring buildings.

The device includes a mounting base supporting a conventional lawn sprinkler and plumbing for conveying water to the sprinkler with a regular garden hose connected to the base. The device is mounted on the roof by tossing a line or rope over the roof and then throwing the device itself onto the roof. This places the device on the roof with the rope on one side of the roof and the garden hose on the other side of the roof. Two people pulling on the hose and the rope from each side of the roof position the device on the roof. Once positioned, a hose faucet connected to the hose is opened to cause water flow to the sprinkler and spray the roof.

In one embodiment of the device, the base includes a water absorbing material wetted with water from the hose to increase the weight of the device and discourage it from moving in response to strong winds. The rope may be used to tether the device.

The device is ideal for single family homes, especially single story buildings and may be used on flat or pitched roofs. The device can be installed in a matter of minutes without requiring a user to climb onto the roof or to use a ladder. It is preferably lightweight, to make it easier to mount it on the roof and it can be significantly weighed down after mounting by filling it with water. As a standard garden hose is used for the source of water it can be mounted by an average person and requires neither a firefighter nor a professional to mount. Once mounted, and the water faucet activated, the device may be left unmonitored to water the roof, and activities relating to evacuation may be undertaken. The device may be stored near the garden hose and faucet to have it is readily available, especially during periods of high fire danger. It can also be installed by a firefighter or a neighbor, in case a resident of the home is out. As the device is lightweight and inexpensive, firefighters can have a large supply of the devices on their trucks for use on homes potentially in the path of a spreading fire.

BRIEF DESCRIPTION OF THE DRAWINGS

The present invention will be described with greater specificity and clarity with reference to the following drawings, in which:

FIG. 1 is a perspective view of a roof soaking device shown mounted to a roof of a building;

FIG. 2 is a perspective view of the roof soaking device;

FIG. 3 is a cross sectional view taken along line 3—3, as shown in FIG. 2;

FIG. 4 is a cross sectional view taken along line 4—4, as shown in FIG. 2; and FIG. 4A is a top view of a latch.

DESCRIPTION OF THE PREFERRED EMBODIMENT

FIG. 1 illustrates a roof soaking device 10 located on roof 12 of a building 14, such as a home. The device has a mounting base 16 supporting a sprinkler 18. A hose 20 provides water to the sprinkler. A line or rope 22 extends from base 16 to aid in positioning the device on the roof.

Referring particularly to FIGS. 2 and 3, base 16 has an outer cover 24 formed from a material impermeable to water, such as a vinyl or other plastic, and a water absorbing filling 26. The filling may be a sponge pillow(s) inside the outer cover to give the base its form. Though illustrated as being generally square, base 16 may be of a variety of different geometric shapes. The base is lightweight and weighs in the order of less than ten pounds and may weigh in the range of two and five pounds. Such light weight will enable an individual of average strength to toss the device onto the roof of a single story building.

Sprinkler 18, which may be a commercially available sprinkler providing a continuous or an oscillating spray pattern, may include a circular wide head 28 and a base 30, interconnected by a narrow neck 32. The neck extends through an aperture 34 in top surface 36 of cover 24. The diameter of aperture 34 is intermediate the diameter of the neck and the diameters of the sprinkler head and its base. Manufacturers providing suitable sprinklers include companies referred to as Orbit and Rainbird (both of which are registered trademarks). A variety of sprinklers other than the type illustrated, may be mounted on the base.

A pipe 40 is attached to sprinkler 18, such as at neck 32, to provide fluid communication between the pipe and the sprinkler. The pipe lies beneath cover 24 and extends to and through an opening 41 in side 42 of base 16. A conventional hose coupling 44 is at the terminal end of the pipe. The pipe generally lies above filling 26 and serves to hold the sprinkler in place. Holes 45 dispersed along the pipe permit water to seep into the filling in the base. The weight of the water absorbed by the filling increases the weight of the device and it becomes less likely to be moved by the wind. A water hose 20 (see FIG. 1) or other water source is attached to coupling 44 to convey water to sprinkler 18 via pipe 40 and coupling 44.

As shown in FIGS. 2 and 4, rope 20 is coupled to base 16, generally on a side opposite coupling 44, and attached to ring 54 secured by strap 50. A spool 46 about which the rope is wrapped is attached to top surface 36 of the base by a strap segment 52. Strap 50 may be sewn to the cover 24 by a stitching along the strap. Strap segment 52 wraps about the spool to retain the spool attached to base 16. Ring 54 may be secured between strap 50 and top surface 36 of cover 24, as shown. The length of the rope 20 should be greater than at least half the height of the top of building 14 to allow an individual of average height standing on the ground to grasp the spool end of the rope when device 10 is positioned on the roof.

Device 10 may include handles formed by further straps 60, 62 attached to base 16. A yet further strap 64 may be attached to the base to extend across pipe 40. It is to be noted that straps 50, 60, 62, 64 and strap segment 52 may be formed from a single strap. The free end of strap segment 52 forms a loop for partially encircling spool 46 and is held in place by a latch 66, as shown in FIGS. 2, 4 and 4A. When the device is used, latch member 23 is opened, to release the spool. The latch member includes an elongated turning knob 68, which may be inserted in an elongated aperture 70 of a plate 72 attached to strap segment 52. Knob 68 is turned to engage the strap segment and retain the spool and turned again to permit disengagement and release of the spool.

Before mounting device 10 on a roof, a garden hose 20 is connected to coupling 44 and spool 46 is released from strap segment 52. The spool, with rope 22 unraveling therefrom is tossed over roof 12 of building 14. Device 10, with the attached hose, is thrown onto the roof. This will place base 16 on the roof with the rope dangling from the roof on the other side of the building.

When device 10 has been placed on the roof, with hose 20 and rope 22 on opposite sides of the building, two people pulling on the hose and the rope, respectively, can position the device to a selected location on the roof. Once positioned, the hose faucet is turned on to convey water to base 16 and distribute it through the sprinkler to spread the water on the roof. Rope 22 may also be tied to a part of the house to tether the device and prevent it from being moved by strong winds.

Upon turning on the water faucet, filling 26 inside base 16 of device 10 fills with water to weigh down the base. This additional weight helps to prevent the device from moving in case of strong winds. The maximum weight of the base once filled to capacity is in the order of between eight and twenty pounds, and more specifically between ten and fifteen pounds. Also, additional straps or ropes attached to one or more of handles 60, 62 may be provided to tether the device to keep it from moving.

Device 10 is light weight, inexpensive, and can easily be mounted on the roof of a building. Once mounted, the device can be used to soak the roof of the building with water. The wetted roof will be less likely to catch on fire and it may even serve in the capacity of a fire break to prevent a spread of the fire past the building.

The device is ideal for single home structures, especially single story structures, and may be used on any type of roof, whether flat or pitched. The device can be installed in a matter of minutes without having to climb onto the roof nor does it require the use of a ladder. Since the device is relatively light weight, little effort is needed to mount it on a roof. Since the device can be significantly weighed down after installation by filling it with water, it will remain on the roof, even in high wind conditions. The device fits a standard garden hose, and can be installed and mounted by an average homeowner and does not require a firefighter or a professional for installation. The device in the operating mo de may be left unmonitored to water the roof while the house or building is being evacuated. The device may be stored near a garden faucet readily available for use, by the homeowner, a firefighter or a neighbor. Furthermore, since the device is light weight and inexpensive, firefighters can have a large quantity of the devices on hand for installation on a large number of homes when the spread of a wild fire to the homes is imminent.

I claim:

1. A device for discouraging the spread of a fire to the roof of a building, said device comprising:

a) a base including an outer cover and filling inside said outer cover, said filling comprising a water absorbing material;

b) a sprinkler mounted on said base, said sprinkler adapted to be coupled to a water source; and c) a rope coupled to said base, said rope being at least long enough for an individual standing adjacent the building to grasp said rope when said device is positioned on the roof of the building.

2. The device as set forth in claim 1 wherein said device weighs less than about 10 pounds when not filled with water.

3. The device as set forth in claim 1 wherein said device weighs more than about 10 pounds when filled to capacity with water.

4. The device as set forth in to capacity claim 1 wherein said sprinkler comprises a top section and a neck section beneath said top section, said top section being wider than said neck section, and wherein said base comprises an outer cover having an aperture at a top surface thereof for penetrably receiving said neck section but not said top section.

5. The device as set forth in to capacity claim 1 including a pipe interconnecting said sprinkler with the water source.

6. The device as set forth in claim 1 including a spool for storing said rope.

7. The device as set forth in claim 6 including a strap element for releasably attaching said spool to said base.

8. The device as set forth in claim 7 wherein said strap element is formed from a strap attached to the base and extending therefrom.

9. The device as set forth in claim 1 including a hose in fluid communication with the water source.

10. The device as set forth in claim 1 including handles attached to said base.

11. A device for discouraging the spread of a fire to the roof of a building, said device comprising:

a) a base;

b) a sprinkler mounted on said base, said sprinkler adapted to be coupled to a water source;

c) a pipe interconnected with said sprinkler and a coupling attached to said pipe for engagement with the water source;

d) said base including an outer cover and water absorbing filling within said outer cover, said pipe being located at least partly within said cover and including a plurality of holes; and e) a rope coupled to said base, said rope being at least long enough for an individual standing adjacent the building to grasp said rope when said device is positioned on the roof of the building.

12. The device as set forth in claim 11 wherein said coupling is on one side of said base and wherein said rope extends from an opposite side of said base.

13. The device as set forth in claim 11 including a hose for engaging said coupling and the water source.

14. A method of wetting a roof of a building with water, said method comprising the steps of:

a) mounting a base on the roof, which base includes a filling;

b) providing a spray of water from a sprinkler supported by the base;

c) soaking the filling with water during exercise of said step of providing; and d) positioning the base on the roof with a rope attached to the base.

15. The method as set forth in claim 14 including the step of attaching a hose to the base prior to exercise of said step of mounting.

16. The method as set forth in claim 14 wherein said step of positioning is carried out with the rope and the hose.

17. The method as set forth in claim 14 including the step of storing the rope on a spool attached to the base.

* * * * *